United States Patent [19]

Grant

[11] Patent Number: 5,053,589

[45] Date of Patent: Oct. 1, 1991

[54] VIBRATION SENSING DEVICE

[76] Inventor: John T. Grant, Wensum Cottage, Ringland, Norfolk NR8 6AB, England

[21] Appl. No.: 545,709

[22] Filed: Jun. 29, 1990

[51] Int. Cl.[5] ..... H01H 35/14

[52] U.S. Cl. ..... 200/61.45 R; 200/61.51

[58] Field of Search ..... 200/61.45 R-61.53

[56] References Cited

U.S. PATENT DOCUMENTS

| | | | |
|---|---|---|---|
| 2,369,977 | 2/1945 | O'Toole | 200/61.51 |
| 4,212,208 | 7/1980 | Weale et al. | 200/61.45 R X |
| 4,339,640 | 7/1982 | Grant | 200/61.45 R |
| 4,368,637 | 1/1983 | Anderson | 200/61.45 R X |
| 4,686,335 | 8/1977 | Grant | 200/61.51 X |

*Primary Examiner*—J. R. Scott

[57] ABSTRACT

A vibration sensing device comprises an insulated housing having supported therein a weight and a centrally extending conducting shaft. Two spaced parallel conductors extend across the housing and engage the shaft, one above and one below the shaft and engaging the top of the shaft and the bottom of the shaft, respectively. The weight presses the shaft down on the nearer conductor and up against the farther conductor. The shaft thus acts as a lever using the near conductor as a fulcrum and pressing upwardly against the farther conductor. The shaft thus bridges the two conductors and connects them. The housing when mounted with the shaft horizontal maintains a closed circuit which will be opened when the housing is subjected to vibrations such as those occurring during a break-in. The opening of the circuit is used to actuate an alarm. The sensitivity of the device may be adjusted by moving the conductors with respect to one another, an adjusting screw available outside the housing being provided for this purpose.

8 Claims, 2 Drawing Sheets

VIBRATION SENSING DEVICE

This invention relates to vibration sensing devices which may be employed, for example, in security systems such as those used for detecting forcible entry to a building structure.

This device or detector is of the type wherein an electric circuit is maintained energized and is subject to resistance changes or interruption in the event that vibrations such as those occurring during forcible entry of a building are impressed thereon. These devices include engaging contacts or switches which are normally closed and are maintained closed by gravity acting on an associated free moving mass sometimes referred to as a weight. The body of the device is normally firmly attached to the building structure. During vibration of the building structure various forces may be experienced, and, in the presence of accelerating forces, the switch elements may move, however, the mass will tend to remain relatively stationary due to its inertia. During normal vibration of the device the mass will remain in position and the switch contacts will be maintained closed until high frequency vibrations such as those occurring during a break-in are received and cause the vibration and momentary change of resistance upon separation of the contacts. The electrical signals produced by the change in pressure and particularly by the separation of the contacts are analyzed and processed electronically and are used to signal an alarm.

The operation of the detecting devices is improved by increased pressure on the closed contacts, and devices have been provided which employ leverage to increase the pressure at the contacts and assure more positive and reliable detection of the signals. For example, it has been found that improved performance can be obtained by employing leverage to increase the effect of vibrations of the mass when applied to the contacts.

It is an object of the present invention to provide an improved arrangement for increasing the effectiveness of a lever system in the detection of high frequency signals such as those existing during the break in of buildings.

Further objects and advantages of this invention will be apparent from the following description and the features of novelty which characterize this invention are set forth in the claims appended to and constituting a part of this specification.

SUMMARY OF THE DISCLOSURE

A device for detecting shock vibrations such as those occurring during a break-in of a building, comprises an insulated housing for firm attachment to the building and having a mass, or body freely mounted therein. The mass is free moving and has a conducting rod attached thereto which is positioned in crossed engagement with two spaced rod-like contact terminals and bridges the terminals to provide a connection in the warning circuit. The rod which acts as a lever pressing against the two terminals completes the circuit which is momentarily broken when the device is jarred and the warning signal circuit is thereby activated. The spacing of the two terminals relative to the mass may be adjusted to change the sensitivity of the device. The device may include an arrangement for pressing the mass or body against the housing wall to prevent its movement and thereby avoiding damage to the device during handling or shipping.

DESCRIPTION OF THE PREFERRED EMBODIMENTS

Figure 1:
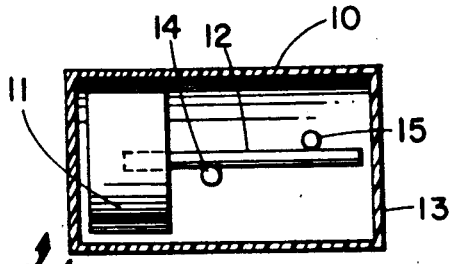
In FIG. 1 is a somewhat diagrammatic side elevation view of the device of the invention with the housing in section.
Figure 3:
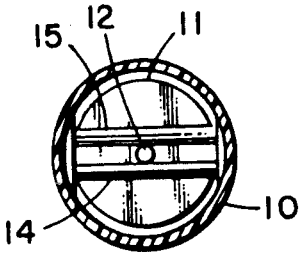
FIG. 3 is an elevational end view of the device of FIG. 1 with the front end wall removed.
Figure 2:
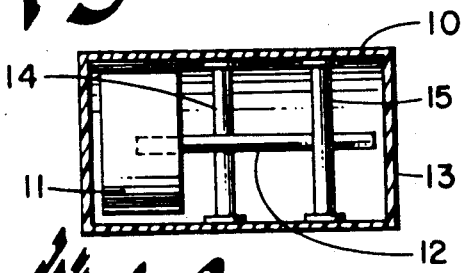
FIG. 2 is a plan view of the device of FIG. 1 with the housing in section.
Figure 4:
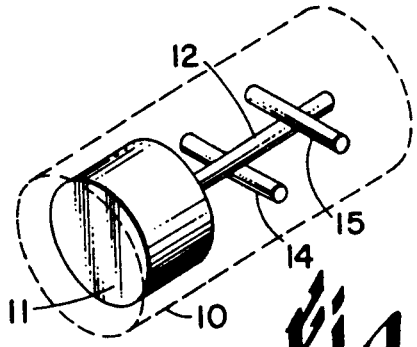
FIG. 4 is a diagrammatic perspective view of the weight and contacts of FIG. 1 shown outside the housing, the housing being indicated in dotted lines.

The embodiment of the invention as illustrated in FIGS. 1 through 4 comprises a housing 10 of suitable insulating material preferably a thermoplastic. A cylindrical body 11 is held in spaced relationship to the interior of the housing on a rod or shaft 12 which is a conductor preferably of circular cross section. The body may be metallic or non-metallic and when metallic is preferably made of a non-ferrous material such as brass and may be plated with a protective material such as nickel. The shaft is preferably connected to the center of the body 11, and extends from the body toward the end wall 13. The combined length of the body and shaft height is less than the interior length of the housing. The mass is spaced from all sides of the housing 10, the shaft 12 carrying the mass or body 11 is supported on spaced conductors 14 and 15 which are arranged in contact with the shaft at the bottom and top, respectively. The body is spaced from the housing 10 on all sides and is free to move. Thus the weight tends to rotate the shaft about the conductor 14 and urges it upwardly against the conductor 15. The shaft 12 thus constitutes a moment arm which bridges and connects the conductors 14 and 15. Conductors 14 and 15 are at right angles to the shaft 12 and since all these conductors preferably have rounded and preferably circular cross sections, the desirable "cross-bar" or "cross-point" type of contact is achieved. Conductors 12, 14, and 15 are preferably made from a hard but resilient material preferably a beryllium copper alloy or a suitable bronze. These conductors are coated with a noble metal such as gold to ensure low contact resistance. The shaft or bar 12 acts as a bridging member connecting the conductors 14 and 15 and the contact points are held under relatively high pressure by the lever action resulting from the mounting of the body or mass.

When acceleration forces are applied to the housing 10, they will be transferred to the bar 12 by the lower conductor 14 causing the bridging conductor 12 to be momentarily displaced due to the inertia of the mass or body 11. Leverage due to the mass 11 results in higher contact pressure at the points of rest against the contacts 14 and 15. In the arrangement as illustrated, the spaced conductors hold the central shaft in a substantially horizontal position. The contact pressure between the conductors 14 and 15 and the shaft 12 is determined by the ratio of the distance between the two conductors 14 and 15 and the position of the center of gravity of the weight 11 determines the actual contact pressure between the conductors. High contact pressure is desired in order to overcome oxide and other contamination on the electrical contacts over long periods of time.

During the operation of the sensing device of this invention and the vibration of the device, the housing and associated fixed electrical contacts will undergo accelerating forces and will move whereas the body or mass loses contact with its points of rest. The electrical signals resulting from this momentary opening of the circuit will be suitably analyzed and processed by electronic means and used to provide a signal of an alarm condition.

Figure 5:
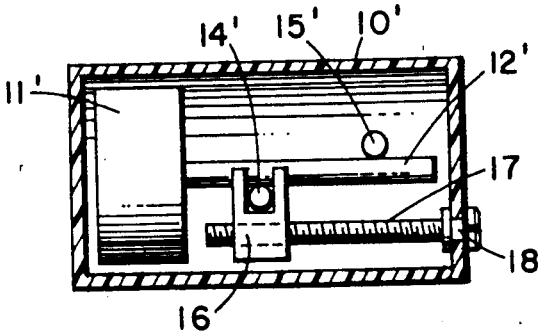
FIG. 5 is a somewhat diagrammatic side elevation view of another embodiment of the invention and in a high sensitivity position with the housing in section.
Figure 6:
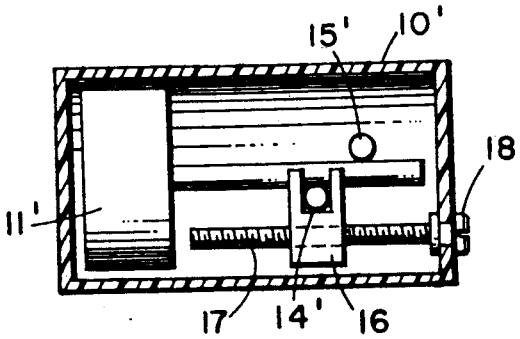
FIG. 6 is a view similar to FIG. 5 with the lower contact moved to a different and lower sensitivity position.
Figure 7:
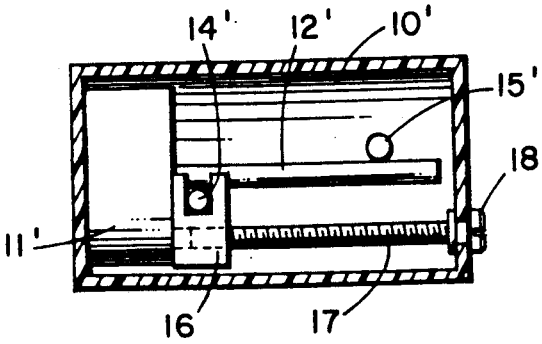
FIG. 7 is a view similar to FIGS. 5 and 6 with the contact moving device in its extreme left-hand mass securing position.

The device illustrated in FIGS. 5, 6, and 7 includes an arrangement for varying the ratio of the distance between the center of gravity of the inertia body and of the two points of rest in engagement with the contacts 14 and 15, respectively. In these figures the parts corresponding to parts in the first four figures are designated by the same numerals each with a prime (′). These figures illustrate an arrangement for adjusting the position of the lower conductor 14′ relative to the upper conductor 15′ which may be moved by turning a screw head 18 to change the position of a slider block or carrier 16. The carrier 16 is constructed of a suitable insulating material and is bifurcated having fingers positioned one on each side of the conductor 14′ along the line of the shaft 12′. A threaded member 17 is provided to adjust the position of the conductor 14′ and may be turned from outside the housing 10′ so that the position of the conductor 14′ may be varied without access to the housing. Adjustment of the carrier 16 to positions along the member 17 produces a change of ratio of the distance between the two retaining conductors 14′ and 15′ and the distance from the conductor 14′ to the center of gravity of the mass 11′ which ratio determines the actual contact pressure on the shaft 12′. For practical purposes the lower conductor 14′ is moved, the upper conductor 15′ could be moved in a similar manner but the movement of the lower conductor 14′ is more practical and is the preferred arrangement for changing the ratio. It is noted that the position of the inertia body may be adjusted in a similar manner along the shaft 12′ and the spaced contacts 14′ and 15′ may be fixed.

To achieve a practical change of sensitivity it is important that the moment arm or the points of rest have a sufficient degree of resilience. Thus low level movements typical of normal background vibrations will be absorbed by the resilience of, say the arm 12′ and will not cause the contact points to open. This would be the case when the ratio of distances is greatest and the maximum length of the moment arm is in use. When the ratio is smallest, the relatively short and less resilient moment arm will undergo less movement and the contacts will open at a lower level of vibration.

FIGS. 5 and 6 illustrate two positions of the carrier 14′ and FIG. 7 illustrates another application of the arrangement for moving the carrier 14′. In this latter figure, the carrier 14 has been moved against the body 11′ and has pressed it against the end of the casing 10′. In this position movement of the body and possible injury during handling or shipment of the device is prevented.

Figure 9:
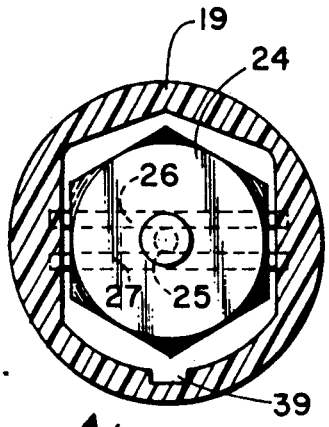
FIG. 9 is a left end view of the device with the housing in section along the line 9—9 of FIG. 8.
Figure 8:
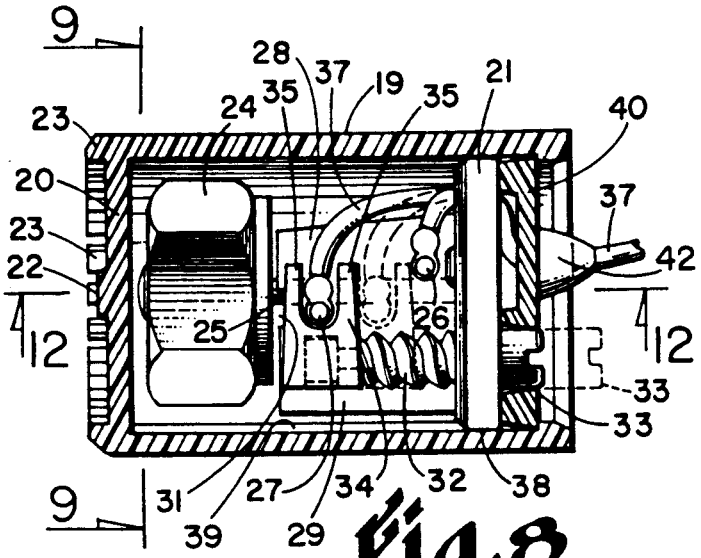
FIG. 8 is a longitudinal elevation view of another form of the vibration sensing device of this invention with the housing shown in section.
Figure 10:
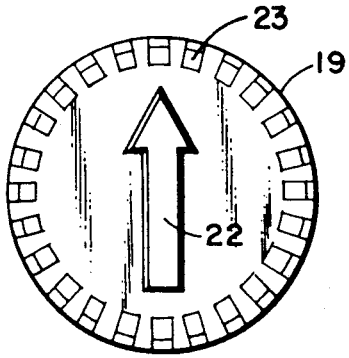
FIG. 10 is a left-hand end view of the device of FIG. 8.
Figure 12:
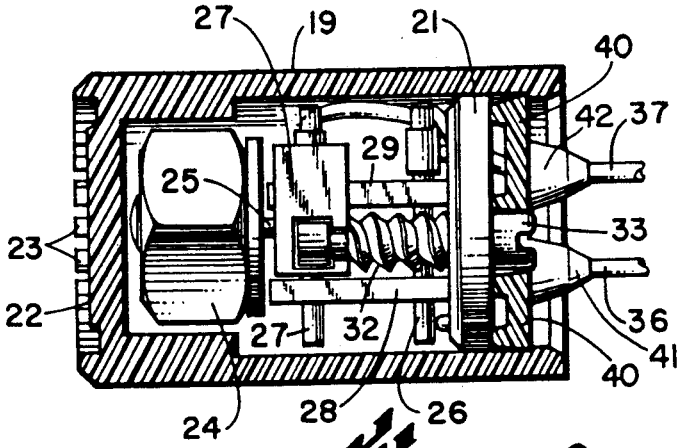
FIG. 12 is a bottom plan view of the device of FIG. 8 with the housing shown in section along the line 12—12 of FIG. 8.
Figure 11:
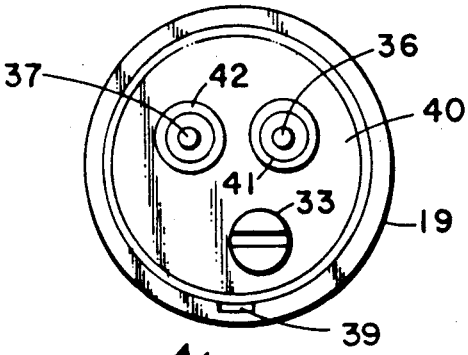
FIG. 11 is a right-hand end view of the device of FIG. 8.

The embodiment of the invention illustrated in FIGS. 8 through 12, inclusive, is a device which can be made in small sizes which are particularly suitable for installation on window structures and the like. This device may, by way of example, be constructed as a cylinder having a length of about three quarters of an inch and a diameter of about one half inch. As shown in FIGS. 8, 9, and 12 the device is provided with a housing 19 of suitable thermoplastic material, and which comprises a cylindrical wall with an integral end wall 20 at the left end and a removable wall 21 pressed into and closing the cylinder near its right-hand end by retaining member 40. The end wall 20 is provided with a readily visible raised arrow 22 on its outer face as shown in FIGS. 8, 10, and 12 this arrow indicating the upright position of the device. About the circumference of the end wall as shown in FIGS. 10, a castellated appearance is provided by twenty-four equally spaced lugs 23 extending radially about the outer circumference of the end wall of the housing 19. This provides a good gripping surface during the handling and installation of the device.

The inertia mass indicated at 24 is of hexagonal configuration as shown in FIG. 9, and is provided with a conducting shaft 25 extending from the center of the mass 24 toward the right-hand end wall of the housing. The right hand end of the shaft 25 does not touch the right-hand end wall 21 of the housing and the weight is supported by two parallel bars 26 and 27 which are of conducting metal and are mounted in the housing so that they extend across the interior as indicated in dotted lines in FIG. 9. The shaft 25 is thus supported between the bars 26 and 27, being at the bottom of the shaft and being movable along the shaft and the bar 26 at the top and extending across the shaft and being held in a fixed position. The weight or mass 24 is thus supported on the bar 27 and the shaft 25 engages the bar 26 and presses upwardly against it so that the two bars 26 and 27 hold the shaft 25 in a horizontal position. The shaft 25 and the bars 26 and 27 thus perform the same functions as the bars 14 and 15 and the shaft 12 of the modification illustrated in FIGS. 1, 2, 3, and 4 and the shaft 12′ and bars 14′ and 15′ of the modification of FIGS. 5, 6, and 7. The conducting bars 26 and 27 are supported on projections or arms 28 and 29 shown in FIGS. 8 and 12 which are molded as parts of the end closure or wall 21 of the housing and have longitudinal slots for holding the bar 27 in position to engage and support the shaft 25 and to afford movement of the bar 27 along the shaft when adjusting the sensitivity of the device. The arms 28 and 29 also have holes near the wall 21 to receive the conductor bar 26 and hold it in a fixed position for engagement with the top of the shaft 25. The entrance 31 to the longitudinal slot in the arm 28 is illustrated in FIG. 8 and the arm 29 is not shown in that figure. The bar 27 may be moved along the shaft 25 by operation of a threaded rod member 32 of insulating material which is threaded in the right-hand wall 21 and is provided with a slotted head 33 which is accessible from outside the housing and may be turned by a screwdriver to adjust the position of the rod 27 along the shaft 25 and with respect to the rod 26. The member 32 is connected to move a bifurcated block 34 as shown in FIG. 8, which has forked members or fingers 35 which bracket the bar 27 so that the bar may be moved along the shaft 25 in either direction. The parts of the device and their functions are generally similar to those of FIGS. 5, 6, and 7 and include the feature whereby the mass 24 may be moved to the left and against the end wall 20 to prevent movement of the mass and injury of the sensing device in the course of the moving or handling of the device.

The rods 26 and 27 are connected to respective conducting wires (not shown) of insulated electrical leads 36 and 37 which wires are provided for connection with the signal detecting circuit. The leads 36 and 37 have reinforcing portions 41 and 42. The only metallic parts of the device are the shaft 25, the conductors 26 and 27 and the wires in the electrical leads 36 and 37 and the mass 24 if metallic.

While particular embodiments of the invention have been described, other applications and arrangements will occur to those skilled in the art. Therefore, it is not desired that this invention be limited to the specific construction shown and described and it is intended by the accompanying claims to cover all modifications which fall within the spirit and scope of the invention.

I claim:

1. A vibration sensing device comprising a housing, an inertia body positioned in said housing and having a shaft rigidly secured thereto and extending therefrom within said housing, a pair of spaced shaft support members mounted in said housing one support member located above said shaft and one support member located below said shaft and both support members normally engaging said shaft, said body and said shaft fitting loosely in said housing and being retained in position by engagement of the shaft with said support members, said one support member located below said shaft being nearer to said body than the other support member said shaft being maintained normally in contact with both said support members simultaneously, said support members comprising conductors, said shaft including means providing a conducting path between its points of engagement with said conductors whereby said means is capable of completing an electric circuit, said shaft being subject to displacement and separation from at least one of said conductors and opening of the electric circuit by acceleration forces to which the housing may be subjected.

2. The invention set forth in claim 1 wherein said shaft and said support members are conducting rods of rounded cross-section.

3. A vibration sensing device as set forth in claim 1 including means for adjusting the sensitivity of said device, said means including means for moving one of said conductors to selected positions along said shaft for changing the distance between said conductors and changing the relative contact positions and pressures at the points of engagement of said conductors and said shaft.

4. A vibration sensing device as set forth in claim 3 including a stop for limiting the movement of said body and wherein said moving means may be moved into engagement with and retain said body against said stop for preventing movement of the body and damage of the device during handling or shipping.

5. A vibration sensing device as set forth in claim 3 wherein said moving means comprises a longitudinal screw member and a bifurcated support member engaging said lower conductor for moving said lower conductor along said shaft upon rotation of said screw member and wherein the head of said screw member is accessible for actuation from outside said housing.

6. A vibration sensing device as set forth in claim 4 wherein said stop is the end wall of said housing and said body is movable to a position against said end wall and said moving means is constructed and arranged to retain said body in secure engagement with said housing.

7. A vibration sensing device as set forth in claim 5 wherein said body is movable to a position against said housing and said means for moving said lower conductor is constructed and arranged to exert pressure against said body and to retain said body in secure engagement with said housing.

8. The invention set forth in claim 3 wherein said housing is closed by an integral wall at one end and is open at the other, and including a removable wall for closing said open end of said housing and wherein said shaft support members and said means for moving one of said conductors are mounted on and carried by said removable wall.

* * * * *